US011986106B2

(12) United States Patent
Guindulain

(10) Patent No.: US 11,986,106 B2
(45) Date of Patent: May 21, 2024

(54) ADAPTABLE PRODUCT STORAGE AND EXTRACTION TRAY

(71) Applicant: JOFEMAR, S.A.

(72) Inventor: Jesus Guindulain, Navarra (ES)

(73) Assignee: JOFEMAR, S.A., Navarra (ES)

( * ) Notice: Subject to any disclaimer, the term of this patent is extended or adjusted under 35 U.S.C. 154(b) by 0 days.

(21) Appl. No.: 17/993,406

(22) Filed: Nov. 23, 2022

(65) Prior Publication Data

US 2023/0157459 A1 May 25, 2023

(30) Foreign Application Priority Data

Nov. 25, 2021 (EP) ..... 21383070

(51) Int. Cl.
*A47F 1/12* (2006.01)
*A47F 5/00* (2006.01)

(52) U.S. Cl.
CPC ..... *A47F 1/125* (2013.01); *A47F 5/005* (2013.01)

(58) Field of Classification Search
CPC ..... A47F 1/125; A47F 5/005; A47F 5/105; A47F 7/144; A47B 57/585; A47B 96/04; A47B 96/021; G06F 11/26; G06F 11/42; G06F 11/007
USPC ..... 211/59.2, 59.3, 43, 184; 108/60, 61; 221/241, 242
See application file for complete search history.

(56) References Cited

U.S. PATENT DOCUMENTS 1,260,610 A * 3/1918 Weed ..... A47B 65/20 211/42
3,450,268 A * 6/1969 Kenzo ..... A47B 65/20 211/42
4,757,915 A * 7/1988 Albright ..... G07F 11/42 221/75
5,228,578 A * 7/1993 Wu ..... A47B 65/20 211/175
5,570,811 A * 11/1996 Wittern, Jr. ..... G07F 11/42 221/242
5,638,963 A * 6/1997 Finnelly ..... A47F 1/125 211/59.3

(Continued)

FOREIGN PATENT DOCUMENTS

CN 107331046 A 11/2017
DE 4134809 A1 9/1992

(Continued)

*Primary Examiner* — Jennifer E. Novosad
(74) *Attorney, Agent, or Firm* — Hayes Soloway PC

(57) ABSTRACT

The present invention relates to an adaptable product storage and extraction tray, intended for being installed in a vending machine having several compartments. The widths of the compartments can be modified in a short time, in a very simple manner and eliminating the need to take out all the products stored in the different compartments to make these adjustments. The tray comprises a base, a front profile, dividing partitions which limit compartments, extractor assemblies, support plates which support the product, where the extractor assemblies, the dividing partitions and the support plates have the possibility of transverse displacement and where the support plates can be transversely coupled to one another and can be separately removed to constantly adjust the width of the compartments.

15 Claims, 11 Drawing Sheets

(56) References Cited

U.S. PATENT DOCUMENTS 6,431,398 B1 * 8/2002 Cook ..... G07F 11/04 221/124
7,124,897 B2 * 10/2006 Bustos ..... B65D 19/44 211/59.3
7,584,861 B2 * 9/2009 Werner ..... B60R 7/14 211/184
7,934,610 B2 * 5/2011 Zeng ..... A47G 21/14 211/70.7
8,096,430 B2 * 1/2012 Lim ..... A47B 47/00 211/41.6
8,657,154 B2 * 2/2014 Obitts ..... G07F 11/64 221/124
8,662,325 B2 * 3/2014 Davis ..... A47F 5/005 211/151
10,492,596 B2 * 12/2019 Pegues ..... A45D 44/02
11,540,628 B2 * 1/2023 Brück ..... G08B 13/1436
2006/0124569 A1 * 6/2006 Parkins ..... A47B 65/20 211/171
2008/0156752 A1 * 7/2008 Bryson ..... A47F 1/126 211/59.3
2010/0108625 A1 * 5/2010 Meers ..... B65D 25/10 211/59.3
2013/0075352 A1 * 3/2013 Mitten ..... B65G 1/023 211/183
2014/0034590 A1 * 2/2014 Szpak ..... A47F 1/12 211/59.2
2014/0217046 A1 * 8/2014 Wang ..... A47B 96/021 211/134
2017/0172315 A1 * 6/2017 Hay ..... A47F 10/02
2017/0367500 A1 * 12/2017 Furui ..... B65G 13/11
2018/0132612 A1 * 5/2018 Felsenthal ..... A47B 55/02
2018/0184814 A1 * 7/2018 Nagel ..... A47F 5/16
2019/0200782 A1 * 7/2019 Kologe ..... A47F 7/0007
2019/0371108 A1 * 12/2019 Sichich ..... G07F 11/24
2020/0093282 A1 * 3/2020 Bruegmann ..... A47F 5/005
2021/0298470 A1 * 9/2021 Lanphear ..... A47B 96/021
2022/0160124 A1 * 5/2022 Hollis ..... A47F 1/12
2022/0322824 A1 * 10/2022 Gatto ..... A47B 96/04
2023/0157459 A1 * 5/2023 Guindulain ..... G07F 11/007 211/59.2

FOREIGN PATENT DOCUMENTS

EP 3076828 A1 10/2016
WO 2015084866 A1 6/2015
WO WO-2015084866 A1 * 6/2015 ..... A47B 57/585

* cited by examiner

A-A

B-B

C-C

ADAPTABLE PRODUCT STORAGE AND EXTRACTION TRAY

CROSS-REFERENCE TO RELATED APPLICATIONS AND PRIORITY

This patent application claims priority from European Patent Application No. 21383070.6 filed Nov. 25, 2021. This patent application is herein incorporated by reference in its entirety.

OBJECT OF THE INVENTION

The present invention relates to an adaptable product storage and extraction tray, intended for being installed in a vending machine, where the tray is provided with laterally movable dividing partitions defining compartments, extractor assemblies and support plates which are also laterally movable, which allow the reconfiguration of the width of the compartments.

As a result of the configuration of the tray, the widths of the compartments can be modified in a short time, in a very simple manner and eliminating the need to take out all the products stored in the different compartments to make these adjustments.

BACKGROUND OF THE INVENTION

In the field of stock management and vending machines, products are often stored in horizontal trays which are usually divided into channels or compartments housing one and the same type of product and extractors which push the products towards a product dispensing area.

In the initial installation of machines of this type and continuously after that, it may be necessary to adapt the compartments to the different product sizes, to adapt the machines at each point of sale to the most commercial products, new products, etc. This flexibility demanded by the market necessarily implies changing the size of the compartments in their three dimensions, i.e., width, depth and height for the correct arrangement of the trays.

In most tray systems on the market that have spirals for pushing products, the motors of the spirals are fixed in the rear part of the tray, such that the flexibility they offer is to place double or single channels or to buy entire trays with a larger or smaller number of motors in the rear part, to adapt the machines to the products.

Furthermore, a little more flexibility is achieved in these systems by repositioning the partitions in the different grooves made in the tray in order to provide this functionality, such that an increase in width of a channel or compartment necessarily implies the decrease in width of the channels contiguous to the former, which causes these systems to be rather inflexible and to require a great deal of adaptation time as the products stored in all the channels involved must be removed and with the displacement of the partitions being physically limited by the body of the spiral of adjacent channels.

In other systems, the extractors and the motors constitute a single component which can be placed in the tray in a number of positions, like the partitions, positioning same in grooves made in the tray for this purpose, such that the adaptation in width is possible with the relocation of the different elements. However, performing this relocation of elements also requires removing the products from the channels which have to be modified, in many cases having to empty the tray of all the products. Furthermore, this system has the conditioning fact that the grooves for locating the partitions and extractors do not have a constant passage.

On one hand, a great deal of time is used in these adaptations, and on the other hand, highly skilled technicians must do operations of this type.

Moreover, there are trays which adapt the width of their compartments by means of rail systems, such as patent document EP3076828A1, for example, which relates to a tray where the partitions and the extractors are attached in a manner so as to be linked to a front rail and another, rear rail. To fix the position and determine the width of the compartment, there are cavities at the base of the tray.

Said trays do not include supports on which the products can rest, and said products easily engage with the parts of the tray. Furthermore, by having to fix the different elements in cavities intended for such purpose arranged at the base, flexibility is limited and a continuous adaptation of the width of the channel is not achieved in a rapid and simple manner. Additionally, the rigidity conferred by said tray is not suitable for products that weigh a lot.

DESCRIPTION OF THE INVENTION

The present invention relates to a product storage and extraction tray, intended for being installed in a vending machine.

The tray comprises a quadrangular base provided with an upper surface and with lateral sides, a rear side and a front side, a front profile linked to the front side, lateral walls and a rear wall starting in the upper part from the corresponding sides of the base, with the front side of the tray being open for dispensing the products. The tray also comprises dividing partitions arranged perpendicularly with respect to the upper surface of the base and distributed parallel to one another, longitudinal parallel compartments defined between the dividing partitions and between the endmost dividing partitions and the lateral walls, and limited by the rear wall and in the lower part by the upper surface of the base, longitudinal extractor assemblies arranged in each compartment which store and push the products towards the front side of the base for the dispensing thereof and longitudinal support plates, located on both sides of each extractor assembly, intended for partially supporting the products transported by the extractor assemblies and where the support plates delimit the width of each compartment.

The extractor assemblies and the dividing partitions are linked to the front profile with the possibility of transverse displacement and the support plates can be linked to the front profile with the possibility of transverse displacement.

The support plates can be transversely coupled to one another and are removable so as to allow the displacement of the extractor assemblies and dividing partitions and modify the width of the compartments.

The tray comprises at least one movable retaining element, which regulates the position of the support plates, the extractor assembly or the dividing partition that is located the closest to a lateral wall, with respect to the lateral wall between a retention position in which it keeps the support plates coupled to one another and in which the support plates, the extractor assembly or the dividing partition that is the closest to the lateral wall maintains a clearance with the lateral wall, and a release position in which it releases the support plates for the removal thereof.

In the mentioned release position, the support plates can be extracted from one of the compartments and introduced into another compartment, thereby changing the width of the compartments. By extracting one or more support plates from one compartment and introducing the same number of support plates in the other compartment, the dividing partitions and the extractor assemblies are also laterally displaced so as to adjust to the width of the compartment, as well as the rest of the support plates.

The width of the compartment is determined by the number of support plates. Once the width of the compartments is determined, the retaining element is placed in the retention position, where it blocks the displacement of the mentioned slidable elements of the tray, which are the support plates, the extractor assemblies and the dividing partitions, and keeps them laterally compacted with one another.

As a result of the configuration of the tray, all the slidable elements can be slid transversely over the front profile, where in case of a reconfiguration of the products in the storage tray, widths of the compartments, also known as extraction channels, can be modified in the shortest time possible, eliminating the need to take out all the products stored in the different compartments to make these adjustments.

Furthermore, the configuration of the tray is applicable to different widths of machines. The proposed tray intends to provide the greatest flexibility when reconfiguring trays, allowing both dividing partitions and extractor assemblies to be able to move laterally without having to be taken out of the trays of the machine for reconfiguration, with the waste of time that this represents. Likewise, the support plates are also transversely displaced.

Thus, as already mentioned, the flexibility for adapting compartment sizes, the time savings and the simplicity for being handled by any unskilled person stand out among its main advantages.

The front profile can be made of aluminium and can comprise an outer surface, intended for facing the dispensing area, and a preferably ribbed inner surface. The front side of the base is linked to said ribbed area, with a segment of the profile above the upper area of the tray and another segment of the ribbed surface in the lower area which serves to be gripped by a user and move the entire tray, since the base is fixed to the front profile. The outer surface serves to house identification labels and displace them laterally without taking them out of their location.

One of the functions of the support plates is to form a longitudinal support where the products partially rest to release the profile which imparts structure to the tray in the front part and to form a continuous surface over which they slip as they are pushed by the driving action of the extractor assembly, facilitating the outlet thereof. To release the front profile, the support plates protrude from the uppermost part of the front profile.

Another one of the functions of these support plates is to provide the chosen separation between all the elements of the tray, the dividing partitions and the extractor assemblies. The plates have a fixed passage, where they can be laterally stacked as many times needed, increasing or decreasing the separation in passages of a predefined width, for example, of 5 mm.

The support plates can comprise on one of their faces a recess and on another one of their faces a projection intended for being housed in the recess of another contiguous support plate. In this way, they are all designed to fit with one another such that they are captured by a system of projections and recesses which laterally fit with one another.

Additionally, both the extractor assemblies and the dividing partitions can have a fitting surface on both sides, which are complementary to the recesses and projections of the support plates, and which allow the lateral stacking of the dividing partitions, the extractor assemblies and the support plates in a retention situation. These fitting surfaces are also recesses and projections identical to those of the support plates, which are arranged on the outermost faces of the extractor assemblies and of the dividing partitions.

Thus, the support plates would be configured to laterally fit with one another and with the extractors and the dividing partitions, in a non-permanent manner. In this way, the support plates fill the entire space between the dividing partitions and the extractor assemblies such that there is no space whatsoever where the corners of bags can be caught.

The tray is therefore always filled with the dividing partitions, the support plates and the extractor assemblies until completing the entire width thereof. Furthermore, the reconfiguration of the separating spaces between the different components forming an extraction channel is entirely visual since each support plate has a predefined and therefore known thickness, and simply counting the number of support plates intercalated in each compartment is sufficient for delimiting the suitable separation.

The lateral stacking of all the support plates confers robustness to the assembly to maintain the perpendicular arrangement of the dividing partitions and to enable supporting weight on the tray. It should be pointed out that this type of vending machine must be robust against vandalism, so it is very important for the partitions to maintain the perpendicular arrangement with respect to the tray, because they carry the product retention systems. The product retention systems can be peg type or strip type stops, depending on the type of extractor assembly, which prevent the products from falling off the tray.

As mentioned, the retaining element is in charge of laterally compacting the movable elements. The retaining element can be a wedge assembly, a part housing a spring therein or any element that serves to laterally compact and loosen the support plates. The support element preferably comprises a bushing partially housed in at least one pass-through cavity made in the support plates, in the extractor assemblies or in the dividing partition and an attachment element partially housed in the bushing. The bushing is housed in the part closest to the lateral wall, which can be an extractor assembly, a dividing partition or a support plate.

In a release position the attachment element is completely introduced in the bushing, and in a retention position the attachment element contacts the lateral wall, blocking the sliding of the elements. The retaining elements are preferably two per tray, such that they must have two pass-through cavities per support plate, extractor assembly and dividing panel.

The front profile on which the dividing partitions and the extractor assemblies laterally slide and which support the support plates furthermore performs tray reinforcement functions helping to reach bending strengths which allow a single tray to be produced regardless of the weight to be supported, even supporting weights of up to 60 kg, standardising production. Additionally, this tray can subsequently be reconfigured for heavy products, without adding anything, without having to modify heights and dispensing with a useful space for the products for sale. In this way, the products to be sold in each machine will not be limited by the size of the compartments thereof, but rather the compartments will be adapted to the products to be offered.

Preferably, the dividing partitions and the extractor assemblies are additionally linked in a slidable manner to the rear wall at the ends opposite those linked to the front profile. The extractor assemblies and the dividing partitions thereby slide in a guided manner at their two ends, achieving a controlled displacement movement.

In the new system object of this patent, the dividing partitions and the extractor assemblies are inserted in a rib or channel of the front profile such that the lower part of the dividing partitions and the extractor assemblies have a design which copies the inverse form of the front profile, said parts fitting tightly with one another. This design allows the lateral displacement of the dividing partitions and the extractor assemblies while at the same time assuring the perpendicular arrangement thereof with respect to the base of the trays without the need for the help of third parts, so the reconfiguration of partitions and channels again requires less labour.

The tray can comprise a height supplement that can be coupled to the dividing partitions, where one or more can be placed above the other one consecutively as many times needed, whereby obtaining partitions of different heights without the need to arrange as many different references and allowing an adjustment in height of the compartments.

DESCRIPTION OF THE DRAWINGS

As a complement to the description provided herein, and for the purpose of helping to make the features of the invention more readily understandable, in accordance with a preferred practical exemplary embodiment thereof, said description is accompanied by a set of drawings constituting an integral part of the same, which by way of illustration and not limitation, represent the following.

PREFERRED EMBODIMENT OF THE INVENTION

Figure 1:
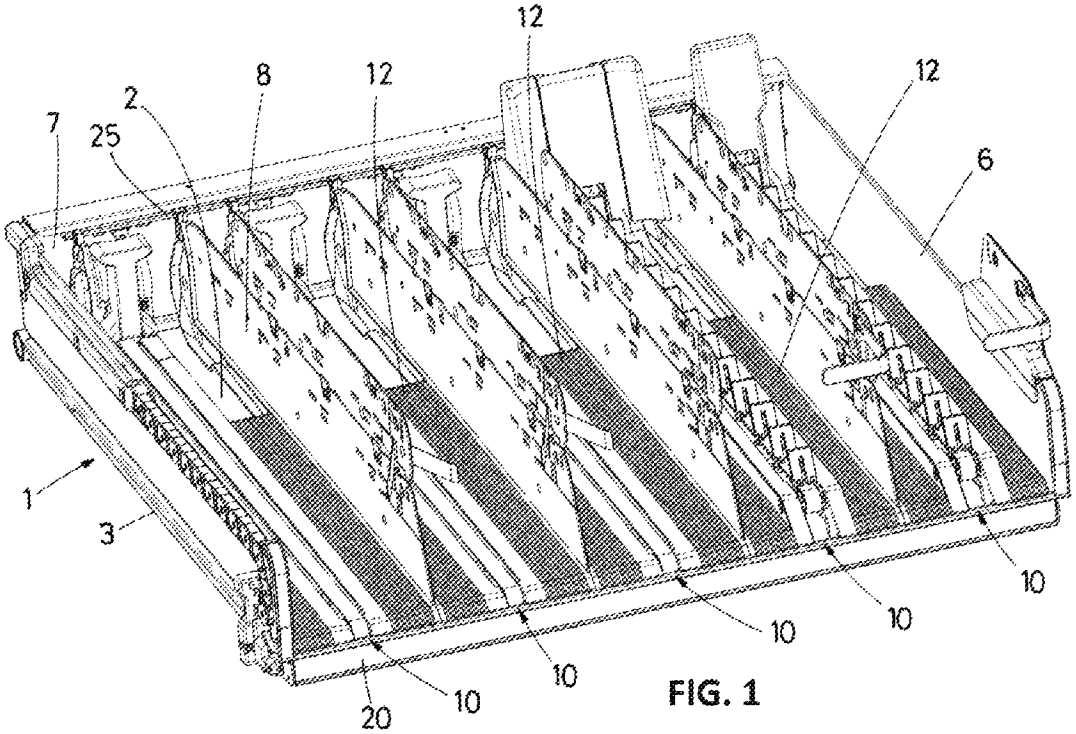
FIG. 1 shows a perspective view of a tray.

FIG. 1 shows a perspective view of a tray according to the present invention, where there can be seen a quadrangular base (1) provided with an upper surface (2) and with lateral sides (3), a rear side (4) and a front side (5), which cannot be seen in the figure.

The tray has a front profile (20) linked to the front side (5) of the tray (1), lateral walls (6) and a rear wall (7) starting in the upper part from the corresponding sides of the base (1), with the front side (5) of the tray being open for dispensing the products.

There can be seen dividing partitions (8) arranged perpendicularly with respect to the upper surface (2) of the base (1) and distributed parallel to one another, longitudinal parallel compartments (9) defined between the dividing partitions (8) and between the endmost dividing partitions (8) and the lateral walls (6) and limited by the rear wall (7) and in the lower part by the upper surface (2) of the base (1). Namely, the tray of the embodiment shown comprises 5 compartments (9).

The tray comprises several longitudinal extractor assemblies (10) arranged in each compartment (9) which store and push the products towards the front profile (20) for the dispensing thereof. In the embodiment shown, the extractor assemblies (10) are centred in each compartment (9).

Additionally, there can also be seen support plates (12) located on both sides of each of the extractor assemblies (10) of each compartment (9), which are intended for supporting the lateralmost areas of the products transported by the extractor assemblies (10) and delimiting the width of each compartment (9).

Namely, the extractor assemblies (10) and the dividing partitions (8) are linked to the front profile (20) and with the possibility of transverse displacement. In the same way, the support plates (12) can be removably linked to the front profile (20) and likewise have the possibility of transverse displacement. The width of the compartments (9) is adapted by means of the transverse displacement of the mentioned elements.

The support plates (12) can be transversely coupled, and are removable, i.e., they can be easily separated from the front profile (20), with the support plates (12) being interchangeable between compartments (9). Thus, the displacement of the support plates (12), the extractor assemblies (10) and dividing partitions (8) is allowed, and the width of the compartments (9) is modified, adapting them to the width of the products supported by each extractor assembly (10).

The tray comprises at least one movable retaining element (13), which cannot be seen in the figure, which regulates the position of the support plates (12) closest to the lateral wall (6) and which is located next to a lateral wall (6). In other alternative embodiments, an extractor assembly (10) or a dividing partition (8) can be the element closest to the lateral wall (6), such that the retaining element (13) would regulate the position of the extractor assembly (10) or of the dividing partition (8) with respect to the lateral wall (6).

When the retaining element (13) is in a retention position, it blocks the movement of all the elements, keeping them at a distance from the lateral wall (6). When the retaining element (13) is in a release position, it stops exerting force against the movable elements such that these can be displaced on the front profile (20) and the support plates (12) can be extracted if the width of the compartments (9) needs to be modified.

Figure 2:
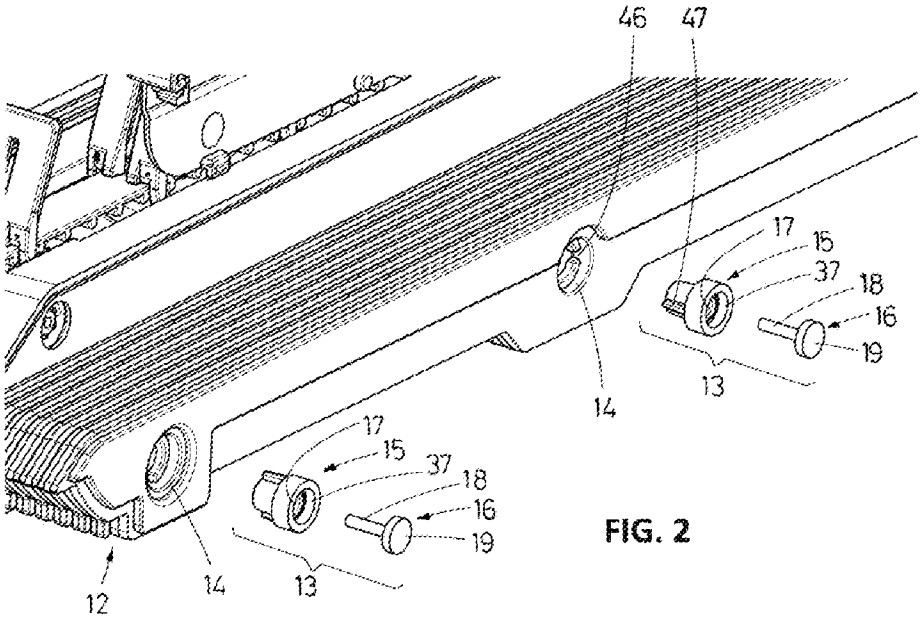
FIG. 2 shows an exploded view of two retaining elements and support plates.

FIG. 2 shows an exploded view of two retaining elements (13) and support plates (12) stacked which are provided with two plate pass-through cavities (14), according to the present invention.

The retaining element (13) is provided with a bushing (15) configured for being housed partially in at least the plate pass-through cavity (14) and with an attachment element (16) intended for being housed partially in the bushing (15).

The bushing (15) in turn comprises a central cavity (37) and a threaded cavity (17) extending from the central cavity (37). The attachment element (16) comprises a threaded rod (18) configured for being housed and screwed in the threaded cavity (17) and a head (19) at one end of the rod (18) configured for being housed in a release situation in the central cavity (37) of the bushing (15) or for contacting the lateral wall (6) in a retention situation.

Namely, the surface which defines the plate pass-through cavities (14) comprises a pair of opposing grooves (46) and the bushing (15) comprises ribs (47) which, in an assembly situation, fit in said grooves (46), preventing the bushing from rotating with respect to the cavity (14). The grooves (46) are present on all the surfaces limiting the pass-through cavities (14, 34, 35).

Figure 4:
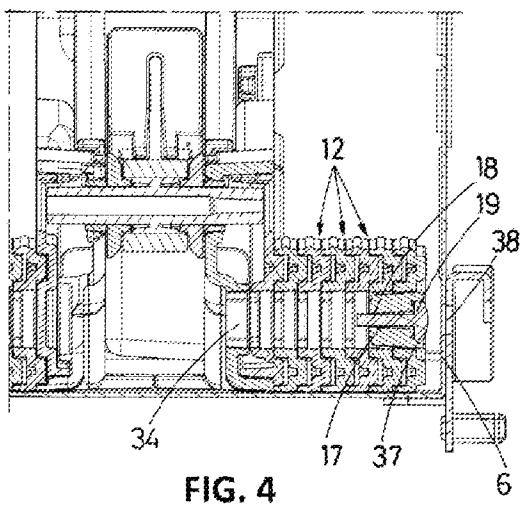
FIG. 4 shows a detailed view of the retaining element in a release position.
Figure 3:
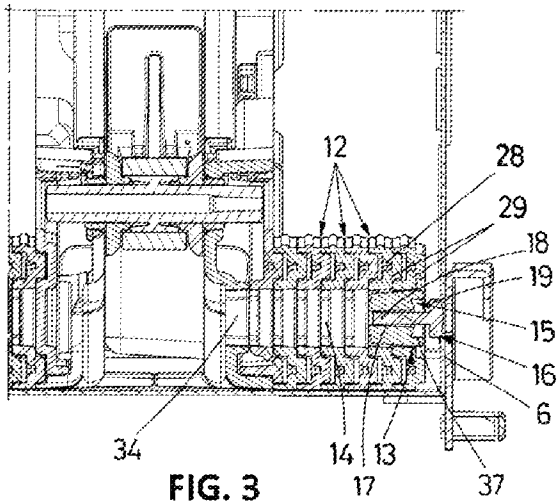
FIG. 3 shows a detailed view of the retaining element in a retention position.

FIG. 3 shows a detailed view of the retaining element (13) in a retention position in which it keeps the support plates (12) coupled to one another and spaced from the lateral wall (6). FIG. 4 shows a detailed view of the retaining element (13) in a release position in which it releases the support plates (12) for the removal thereof and, as pressure is no longer exerted on the support plates (12), allows the displacement of same, as well as of the extractor assemblies (10) and the dividing partitions (8) with respect to the front profile (20).

In the release position of FIG. 4, the attachment element (16) is completely introduced in the bushing (15), as the rod (18) is screwed in the threaded cavity (17), and a space is generated with respect to the lateral wall (6), such that the support plates (12), the extractor assemblies (10) and the dividing partitions (8) can be moved. In this situation, the support plates (12) can be extracted. In contrast, when the rod (18) is unscrewed from the threaded cavity (17), the attachment element (16) moves away from the bushing (15) and contacts the lateral wall (6), keeping the support plates (12) compacted. In this position, the retaining element (13) prevents the transverse displacement movement of the support plates (12), the extractor assemblies (10) and the dividing partitions (8) with respect to the front profile (20) and, accordingly, the removal of the support plates (12).

It can be seen that the lateral wall (6) is provided with a pass-through access borehole (38) of a smaller size than the head (19) of the attachment element (16), which is preferably a screw and allows same to be accessed and activated, for example, with a screwdriver.

The bushing (15) is housed in the plate pass-through cavity (14) of two support plates (12) and has a cone shape which prevents it from slipping and being displaced from its predetermined position. In the embodiment shown, the bushing (15) is housed in the plate pass-through cavities (14) although they can alternatively be housed in an extractor pass-through cavity (34) or in a partition pass-through cavity (35), which cannot be seen in the figure, depending on which part of the tray is located closest to the lateral wall (6).

Figure 5:
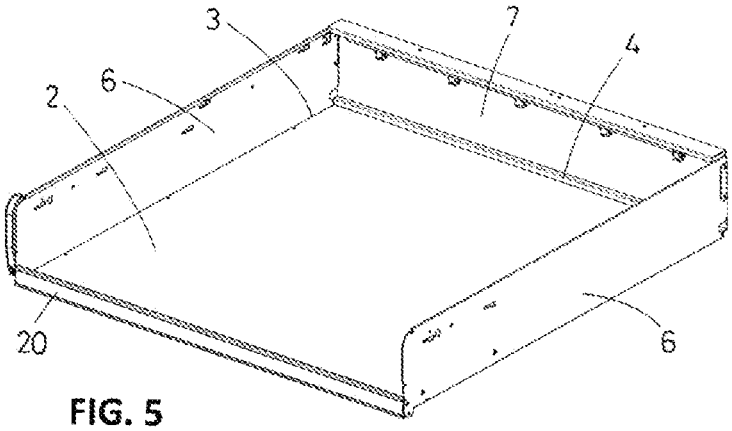
FIG. 5 shows a perspective view of the base, the front profile, the lateral walls and the rear wall.

FIG. 5 shows a perspective view of the base (1) of the tray, the lateral walls (6) and the rear wall (7) extending from the rear side (4) of the base (1). The profile (20) attached to the front side (5) of the base (1) is likewise shown.

The extractor assemblies (10), the dividing partitions (8) and the support plates (12), which cannot be seen in the figure, are supported on the upper surface (2) of the base (1).

Figure 6:
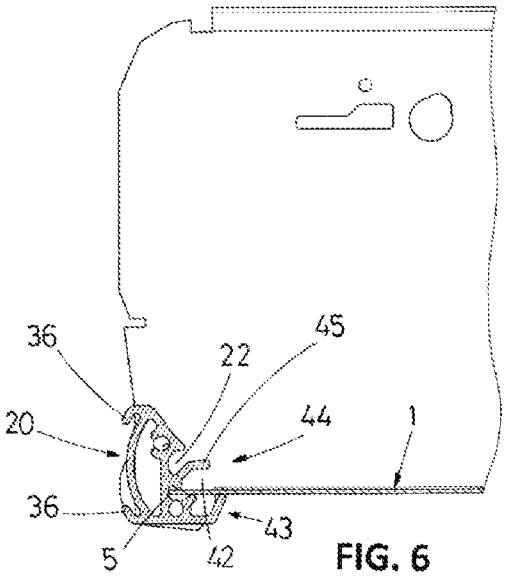
FIG. 6 shows a cross-sectional view of FIG. 5.

FIG. 6 shows a cross-sectional view of FIG. 5, in which it can be seen that the front profile (20) is provided with tabs (36) on its outer surface intended for retaining a product label.

There can be seen a lower area (43) of the front profile (20) which, in the assembly situation, is located below the base (1) and serves to enable the user to grip the front profile (20) with one hand and exert force on it to extract the tray. This lower area (43) of the front profile (20) also serves as support for the base (1). The front profile (20) also comprises an upper area (44), which is located above the tray (1) in an assembly situation.

The front profile (20) comprises at least two channels on its inner surface, a first longitudinal channel (22) which serves to fit the extractor assemblies (10) therein in a slidable manner and a second longitudinal channel (42) which houses the front side (5) of the base (1) and one end of the dividing partition (8), not shown in the figure. Said second longitudinal channel (42) and the first longitudinal channel (22) are separated by a dividing rib (45).

Figure 7:
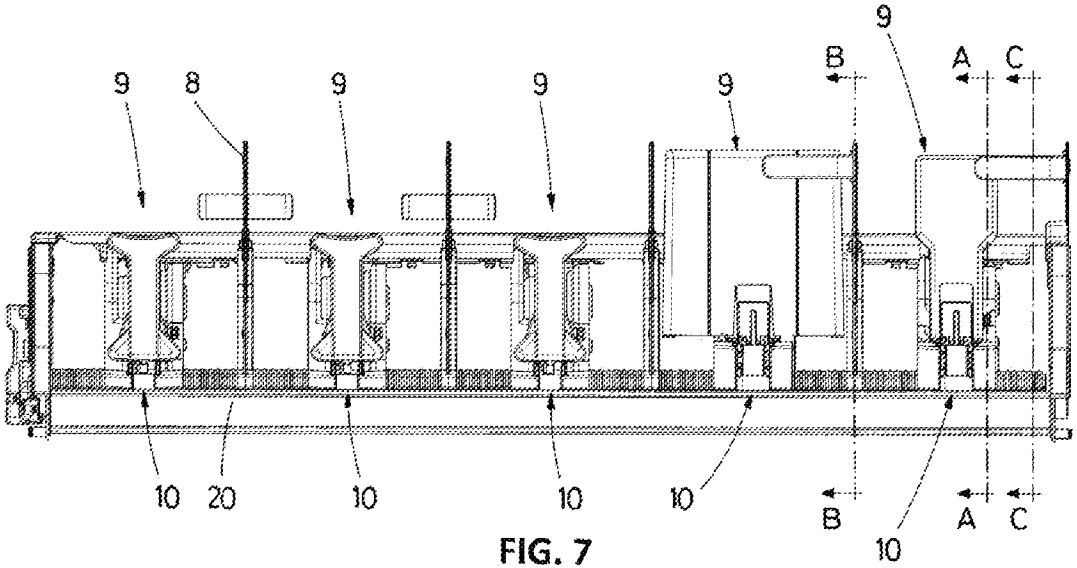
FIG. 7 shows an elevational view of the tray.

FIG. 7 shows an elevational view of a tray, in which the longitudinal parallel compartments (9) defined between the dividing partitions (8) and between the endmost dividing partitions (8) and the lateral walls (6), and limited by the rear wall (7) and in the lower part by the upper surface (2) of the base (1) can be seen in greater detail.

Figure 8:
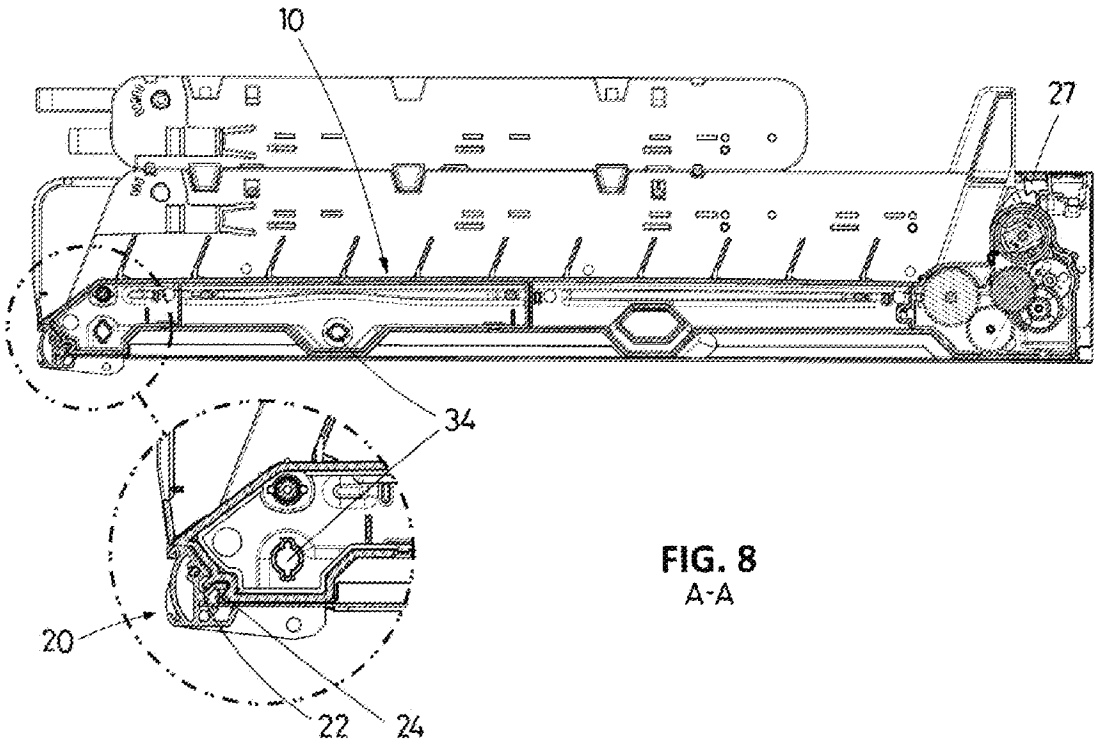
FIG. 8 shows a view of section A-A of FIG. 7, where an extractor assembly can be seen.

FIG. 8 shows a view of section A-A of FIG. 7, where an extractor assembly (10) can be seen in section. The extractor assembly (10) comprises a first extractor protuberance (24) at its end attached to the front profile (20), which is housed in the first longitudinal channel (22) of the front profile (20).

The extractor assemblies (10) are additionally linked to the rear wall (7) at the ends opposite those linked to the front profile (20). Namely, the rear wall (7) comprises a longitudinal rear channel (25), which cannot be seen in the figure, and the extractor assembly comprises a second extractor protuberance (27), housed in the longitudinal rear channel (25) such that the displacement is performed in a more controlled and precise manner since the extractor assemblies (10) are attached in the rear part and in the front part. The extractor assemblies (10) comprise two extractor pass-through cavities (34) configured for partially housing the retaining element (13).

Figure 9:
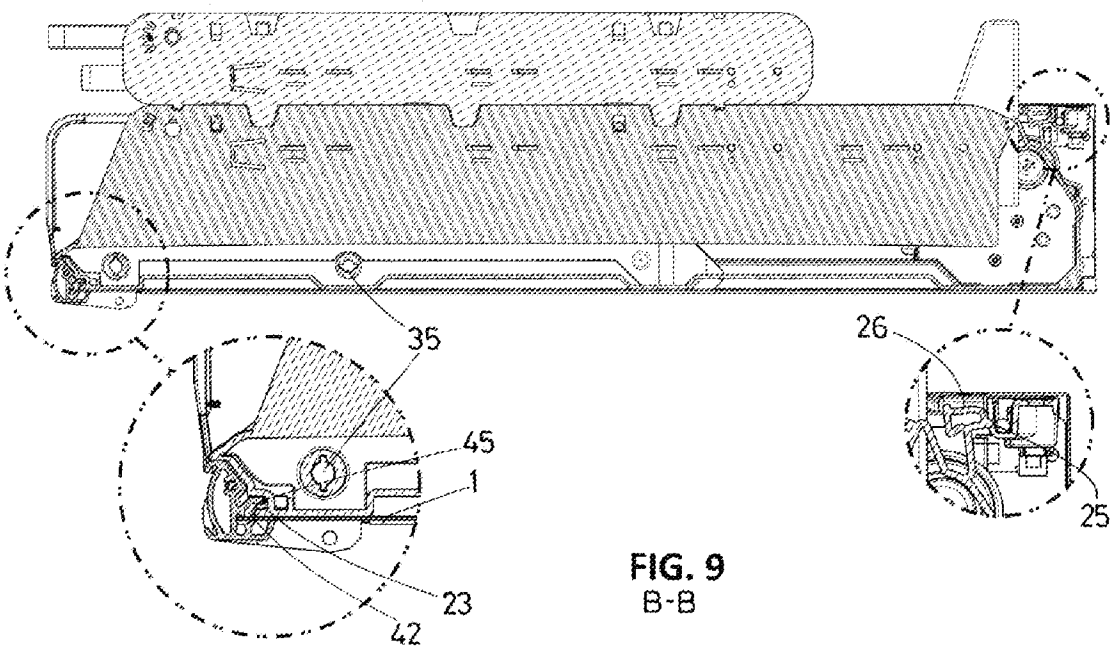
FIG. 9 shows a view of section B-B of FIG. 7, where a dividing partition can be seen.

FIG. 9 shows a view of section B-B of FIG. 7, where a dividing partition (8) can be seen in section. The dividing partition (8) rests on the upper surface (2) of the base (1) and comprises a first dividing protuberance (23) at its end, which is housed in the second longitudinal channel (42) and fits between the rib (45) and the base (1) of the front profile (20), which can be seen in greater detail in FIG. 6. As well as the extractor assemblies (10), the dividing partitions (8) are additionally linked to the rear wall (7) at the ends opposite those linked to the front profile (20). The dividing partition (8) shown comprises two partition pass-through cavities (35) configured for partially housing the retaining element (13).

Figure 10:
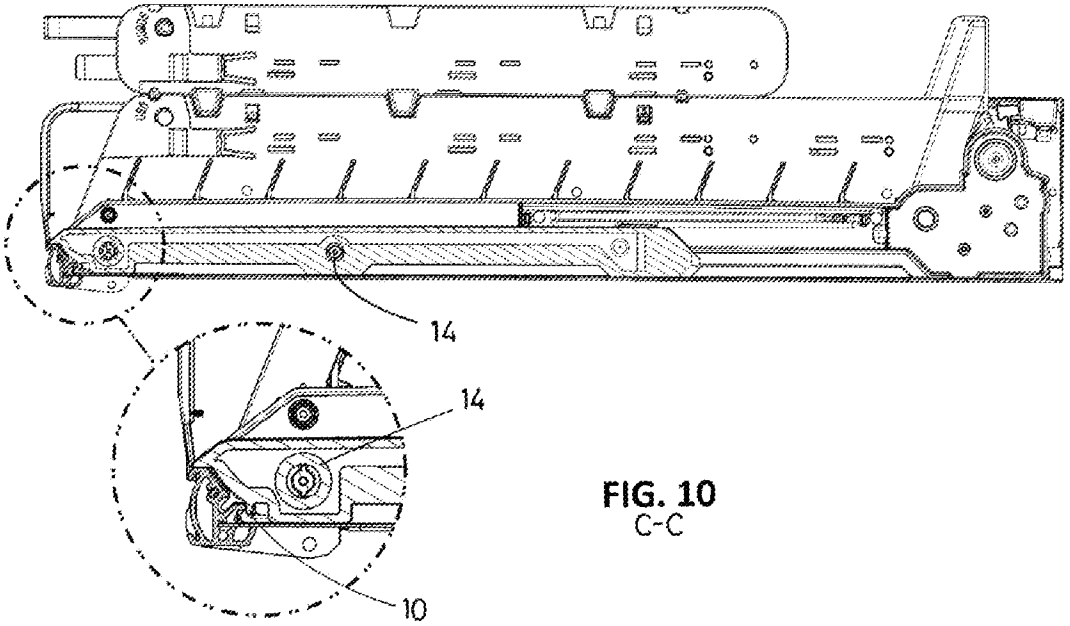
FIG. 10 shows a view of section C-C of FIG. 7, where a support plate can be seen.

FIG. 10 shows a view of section C-C of FIG. 7, where a support plate (12) provided with two plate pass-through cavities (14) for housing the retaining assembly (13) can be seen in section.

Unlike the extractor assemblies (10) or the dividing partitions (8), the end of the support plates (12) rests on the front profile (20) but is not permanently retained, so that the extraction of the support plates (12) is simpler. The end is provided with a stop (30), which partially fits with the inner surface of the front profile (20) in an assembly position and prevents the longitudinal movement of the support plates (12) in the direction towards the front profile (20). The length of the support plates (12) is less than the length of the extractor assemblies (10) so as to facilitate their handling and extraction.

Figure 11:
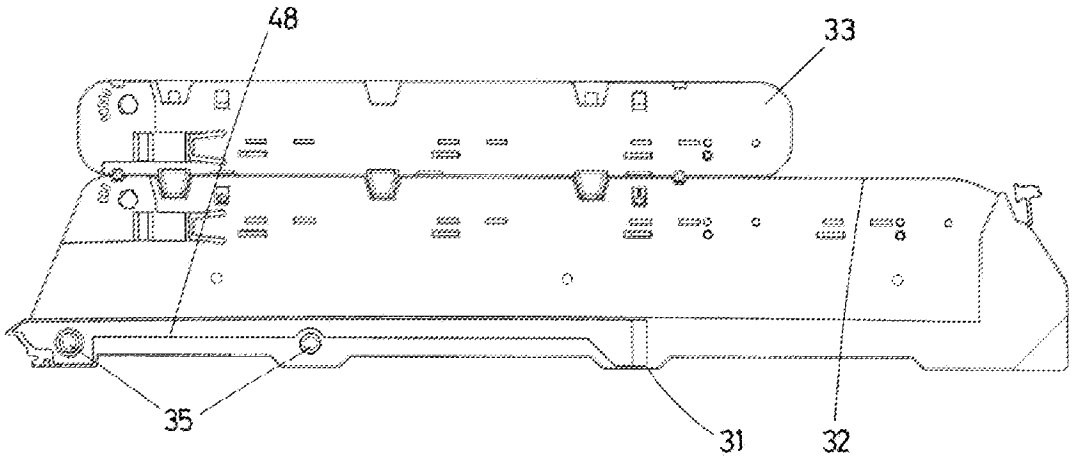
FIG. 11 shows a profile view of a dividing partition.

FIG. 11 shows a profile view of a dividing partition (8), where the dividing partition (8) comprises a lower edge (31) facing the base (1) and a free upper edge (32), and the tray comprises a height supplement (33) that can be coupled to the upper edge (32). The dividing partitions (8) comprise a fitting surface (48) on both sides which are complementary to the recesses (28) and projections (29) of the support plates (12) and which allow the lateral stacking of the dividing partitions (8), the extractor assemblies (10) and the support plates (12) in a retention situation. This fitting surface (48) is a projection on one of the sides of the dividing partition (8), which can be seen in the figure, and a recess on the opposite side, which cannot be seen in the figure.

Figure 12:
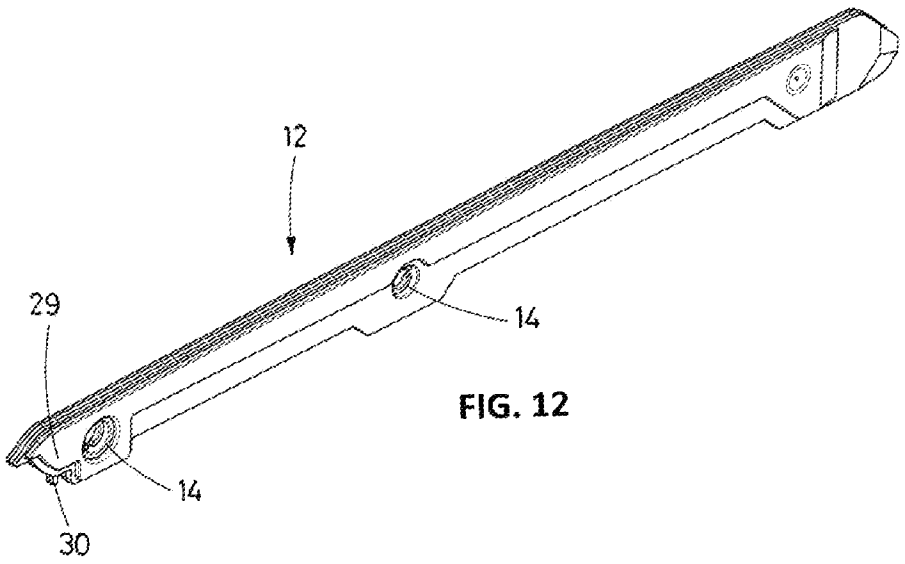
FIG. 12 shows a perspective view of a support plate.

FIG. 12 shows a perspective view of a support plate (12) where the support plates (12) comprise on one of their faces a recess (28), which cannot be seen in the figure, and on the opposite face a projection (29) intended for being housed in the recess (28) of another contiguous plate (8) when the support plates (12) are laterally stacked together, as shown in FIG. 3, where they are stacked.

Figure 13:
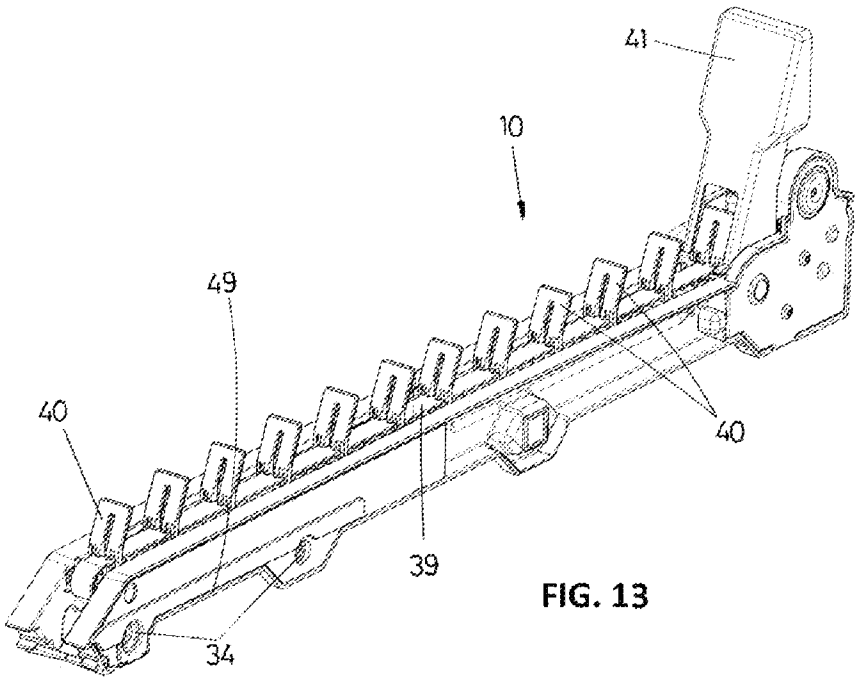
FIG. 13 shows a perspective view of an extractor assembly.

FIG. 13 shows in detail an extractor assembly (10) of a unitary product extractor type, which allows the unitary dispensing of products. The products are supported on a belt (39) which is displaced towards the front profile (20) and are separated by small separators (40). The products are supported on other products, the last of said products being supported on a product support body (41). It can additionally be seen that the extractor assembly (10) has two extractor pass-through cavities (34) configured for housing the retaining element 13. The extractor assemblies (10) comprise a second fitting surface (49) on both sides which are complementary to the recesses (28) and projections (29) of the support plates (12) which allow the lateral stacking of the dividing partitions (8), the extractor assemblies (10) and the support plates (12) in a retention situation. The drives generating the movement of the belt (39) are arranged in the rearmost part of the extractor assembly. This fitting surface (49) is a projection on one of the sides of the dividing partition (8), which can be seen in the figure, and a recess on the opposite side, which cannot be seen in the figure.

The invention claimed is:

1. An adaptable product storage and extraction tray of a vending machine, comprising:

a quadrangular base provided with an upper surface and with lateral sides, a rear side and a front side;

a front profile attached to the front side;

lateral walls and a rear wall emerging from the lateral sides and the rear side, respectively, of the base, with the front side open for dispensing products;

dividing partitions arranged perpendicularly with respect to the upper surface of the base and distributed parallel to one another;

longitudinal parallel compartments defined between the dividing partitions and between the endmost dividing partitions and the lateral walls, and limited by the rear wall and in a lower part by the upper surface of the base;

longitudinal extractor assemblies arranged in each compartment which store and push the products towards the front side of the base for dispensing the products;

longitudinal support plates, located on both sides of each of the longitudinal extractor assemblies partially supporting the products by the longitudinal extractor assemblies, and wherein the longitudinal support plates delimit the width of each compartment, wherein the longitudinal extractor assemblies and the dividing partitions are attached to the front profile being transversely displaceable and the longitudinal support plates are attachable to the front profile being transversely displaceable;

the longitudinal support plates are transversely coupled to one another and are separately removed to allow the displacement of a remainder of the longitudinal support plates of the longitudinal extractor assemblies and of the dividing partitions and modify the width of the compartments; and the tray further comprises at least one movable retaining element, to regulate the position of the longitudinal support plates, the longitudinal extractor assembly or the dividing partition that is located closest to a lateral wall, with respect to the lateral wall, between a retention position in which the at least one movable retaining element keeps the longitudinal support plates coupled to one another and in which the longitudinal support plates, the longitudinal extractor assembly or the dividing partition that is the closest to the lateral wall maintains a clearance with the lateral wall, and a release position in which the at least one movable retaining element releases the longitudinal support plates for the removal thereof.

2. The tray of claim 1, wherein the longitudinal support plates are provided with at least one plate pass-through cavity, the longitudinal extractor assemblies comprise at least one extractor pass-through cavity and the dividing partitions comprise at least one partition pass-through cavity, which are coaxial to one another once assembled, and the at least one movable retaining element is partially housed in at least one of said pass-through cavities.

3. The tray of claim 2, wherein the at least one movable retaining element is provided with a bushing partially housed in at least the pass-through cavity; and an attachment element partially housed in the bushing, wherein when in a release position the attachment element is completely introduced in the bushing, and in the retention position the attachment element moves away from the pass-through cavity, contacting the lateral wall, and preventing the removal of the longitudinal support plates.

4. The tray of claim 3, wherein the pass-through cavities are provided with at least one groove and the bushing comprises at least one rib on an outer surface of the bushing which, once assembled, fits in said groove, preventing the bushing from rotating with respect to the pass-through cavity.

5. The tray of claim 4, wherein the lateral walls are provided with a pass-through access borehole of a smaller size than the head of the attachment element.

6. The tray of claim 3, wherein the bushing comprises a central cavity facing the lateral wall;

a threaded cavity extending from the central cavity; and the attachment element further comprising:

a threaded rod housed in the bushing; and a head extending from one end of the rod, wherein when in the release position, the rod is screwed in by being introduced in the threaded cavity and the head is housed in the central cavity, and in the retention position the rod is unscrewed and the head stays at a distance from the central cavity and contacts the lateral wall, preventing the movement of the plates, the longitudinal extractor assemblies and the dividing partitions.

7. The tray of claim 2, wherein there are two pass-through cavities, and the at least one movable retaining element comprises two movable retaining elements.

8. The tray of claim 1, wherein an inner surface of the front profile comprises at least a first longitudinal channel and a second longitudinal channel, separated by a dividing rib, and where the longitudinal extractor assemblies comprises a first extractor protuberance at an end housed in the first longitudinal channel, where the base is housed at a front edge in the second longitudinal channel and where the dividing partitions comprise a first dividing protuberance fitted between the base and the dividing rib.

9. The tray of claim 1, wherein the dividing partitions and the longitudinal extractor assemblies are additionally attached to the rear wall in a slidable manner at the ends opposite those attached to the front profile.

10. The tray of claim 9, wherein the rear wall comprises a longitudinal rear channel, and where the dividing partitions comprise a second dividing protuberance and the longitudinal extractor assemblies comprise a second extractor protuberance, with both second protuberances being housed in the longitudinal rear channel.

11. The tray of claim 1, wherein the longitudinal support plates comprise on one of their faces a recess and on another one of their faces a projection housed in a recess of a contiguous longitudinal support plate for laterally stacking the longitudinal support plates together.

12. The tray of claim 11, wherein the dividing partitions comprise a fitting surface on both sides and the longitudinal extractor assemblies comprise a second fitting surface on both sides which are complementary to the recesses and projections of the longitudinal support plates which allow the lateral stacking of the dividing partitions, the longitudinal extractor assemblies and the longitudinal support plates in the retention position.

13. The tray of claim 1, wherein the dividing partitions comprises a lower edge facing the base and a free upper edge, and the tray further comprises a height supplement coupled to the free upper edge.

14. The tray of claim 1, wherein the longitudinal support plates are of a smaller length than the longitudinal extractor assemblies so as to facilitate their extraction.

15. The tray of claim 1, wherein one of the ends of the longitudinal support plates rests on the front profile and is provided with a stop which partially fits with the inner surface of the front profile in an assembly position and prevents the longitudinal movement of the longitudinal support plates.

* * * * *